United States Patent [19]

Yackiw

[11] Patent Number: 4,464,864

[45] Date of Patent: Aug. 14, 1984

[54] WEATHERSTRIPPING IN A DOUBLE-HUNG WINDOW

[75] Inventor: Charles Yackiw, Fairport, N.Y.

[73] Assignee: Schlegel Corporation, Rochester, N.Y.

[21] Appl. No.: 504,820

[22] Filed: Jun. 16, 1983

[51] Int. Cl.[3] ..... E05D 15/16

[52] U.S. Cl. ..... 49/404; 49/406; 49/435; 49/485

[58] Field of Search ..... 49/406, 435, 404, 483, 49/485, 486, 489, 458, 445

[56] References Cited

U.S. PATENT DOCUMENTS

| | | | |
|---|---|---|---|
| 2,267,021 | 12/1941 | Glass | 49/435 |
| 2,367,616 | 1/1945 | Robertson | 49/406 |
| 2,568,985 | 9/1951 | Brenneman | 49/406 |
| 2,751,643 | 6/1956 | Dacey | 49/435 |
| 3,060,526 | 10/1962 | Mardulli | 49/406 |
| 4,151,682 | 5/1979 | Schmidt | 49/404 |
| 4,185,416 | 1/1980 | Wilmes | 49/406 |

*Primary Examiner*—Philip C. Kannan
*Attorney, Agent, or Firm*—Cumpston & Shaw

[57] ABSTRACT

Weatherstripping for a double-hung window includes horizontal and vertical weatherstripping elements arranged so that each horizontal weatherstripping element forms a sliding seal with each vertical weatherstripping element to provide a complete seal in a double-hung window without the need for supplemental crack sealing members.

16 Claims, 5 Drawing Figures

WEATHERSTRIPPING IN A DOUBLE-HUNG WINDOW

This invention relates in general to window constructions and more particularly to an integrated weatherstripping system for a double-hung window providing improved sealing over prior art windows and weatherstrips.

Double-hung windows are particularly difficult to seal against air infiltration because of the large number of sliding and compression seals required by the combination of two separately movable sashes with a window frame. Heretofore, a number of different types of weatherstrips have been employed, including flexible sheet metal (bronze) weatherstrips as shown in U.S. Pat. No. 2,267,021; flexible wicking as shown in U.S. Pat. No. 2,367,616; pile fiber weatherstripping as shown in U.S. Pat. No. 2,751,643; plastic weatherstripping; foam weatherstripping and the like. While each of these different types of weatherstrips has provided reasonably effective sealing against drafts and the like, they have all been prone to leak especially at the corners of the window between the upper and lower sash rails and the jambs, and between the ends of the meeting rails and the jambs.

In order to provide more complete sealing, it has been customary to add small auxiliary weatherstrip elements at these troublesome points as illustrated by U.S. Pat. No. 4,300,316. Such auxiliary elements increase the complexity of the overall weatherstripping system and while said to be partially effective, do not represent the optimum construction from a cost, effectiveness or ease of use standpoint.

Accordingly, it is an object of this invention to provide a window and more particularly a double-hung window, including an integrated weatherstripping assembly wherein each horizontal weatherstripping element cooperates with each of the vertical weatherstrip elements to provide a complete seal.

It is another object of this invention to provide a weatherstripping system for a double-hung window wherein all of the weatherstrip elements are easily removable for replacement when required.

It is yet another object of this invention to provide a weatherstripping system employing weatherstripping elements manufactured of compressible foam material that can be manufactured inexpensively and in a variety of shapes.

It is a further object of this invention to provide a weatherstripping system for a double-hung window that may be used in windows with removable sashes.

It is a still further object of this invention to provide a weatherstripping system for double-hung windows wherein the force required to move the sashes from a closed position to an open position is reduced by an arrangement whereby certain of the horizontally-oriented sash weatherstrip elements contact the vertically-oriented jamb weatherstrip elements only when the window is closed.

The aspects of the invention that are believed to be novel are set forth with particularity in the appended claims. The invention itself, along with further advantages thereof, may be more readily understood by reference to the following detailed description thereof along with the accompanying drawing in which:

Figure 1:
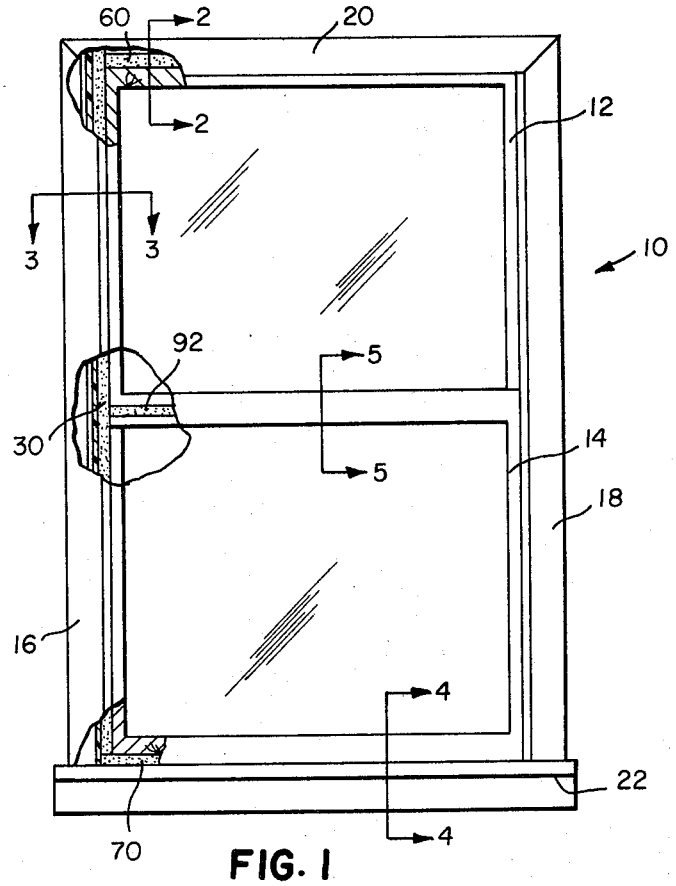
FIG. 1 is a front elevational of a double-hung window including the weatherstripping system of this invention and showing the cooperation between the vertical and horizontal weatherstrip elements in three cutaway portions.

Referring now to FIG. 1, a double-hung window 10 is illustrated including the weatherstripping system of this invention. Window 10 includes upper and lower sashes 12 and 14, respectively, disposed between side rails 16 and 18 for slidable movement between raised and lowered positions. Sashes 12 and 14 also engage upper and lower jambs 20 and 22.

The cooperation of the various weatherstrip elements with the several portions of the window and frame may be appreciated by reference to FIGS. 2–5 along with FIG. 1 and wherein like elements are designated by like reference numerals.

Vertically-oriented side rail weatherstrip elements 30 (FIGS. 1 and 3) and 31 (FIGS. 2, 4 and 5) each comprise a compressible foam body 34 preferably covered by a plastic or other flexible film 36. Weatherstrips 30 and 31 each include three generally vertically-oriented sealing faces 38, 40 and 42 (FIG. 3) for sealing the lower sash 14, the upper sash 12 and the meeting rail weatherstrip elements, respectively.

Side rail weatherstrip elements 30 and 31 are mounted within U-shaped channels 46 in jamb liners 50, which liners may be formed in any conventional fashion such as by extrusion, and is typically made from aluminum or plastic and fastened to a wooden core 52. Such jamb liners are conventional and as such, form no particular part of this invention except as they cooperate with weatherstrip elements of the invention.

Side rail weatherstrip elements 30 and 31 are formed by conventional means as described, for example, in U.S. Pat. Nos. 3,700,368 and 3,781,390, the disclosures of which are herein incorporated by reference. Side rail weatherstrip elements 30 may be attached to jamb liners 50 by providing weatherstrip element 30 with a rigid backing member for press fitting into liner 50. At least the sealing faces of weatherstrip elements 30 and 31 are preferably covered with a low friction polyethylene covering for minimizing the force required to raise and lower sashes 12 and 14.

Figure 2:
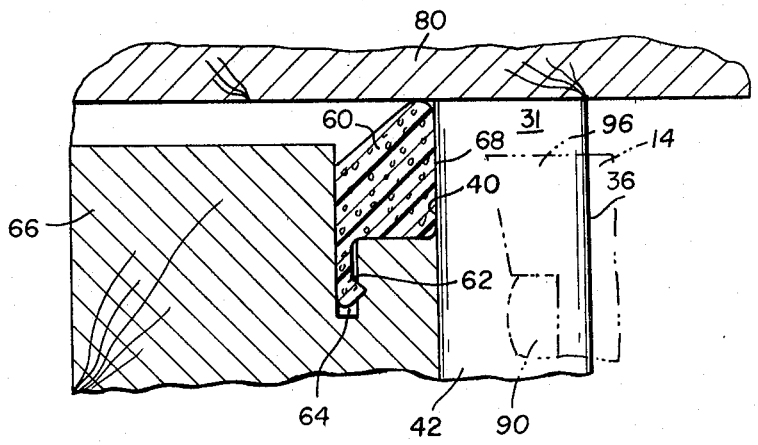
FIG. 2 is a sectional view of the upper sash rail weatherstrip element taken along line 2—2 of FIG. 1.
Figure 3:
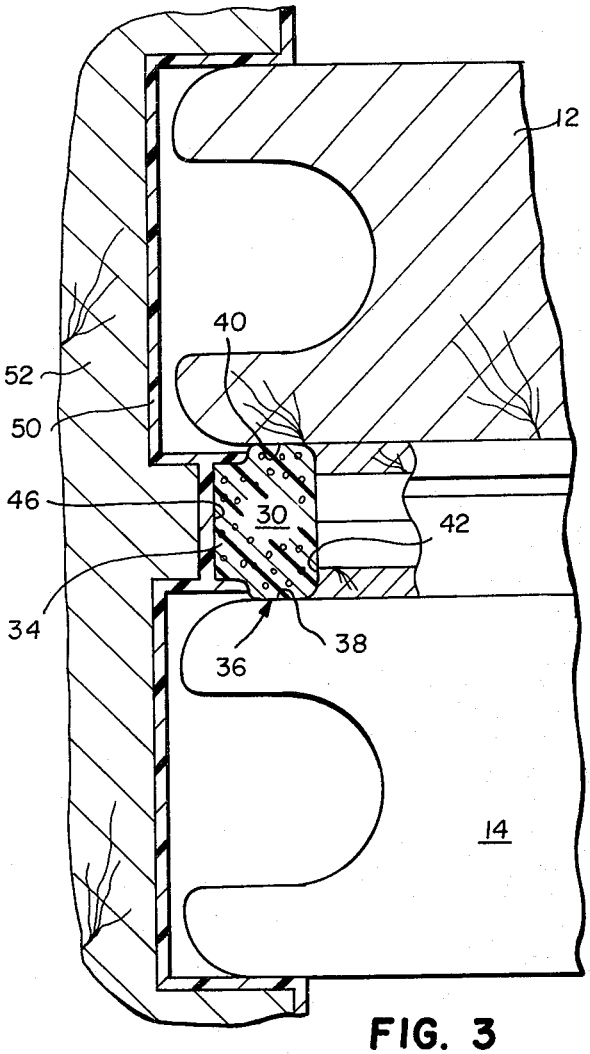
FIG. 3 is a sectional view of the window showing the cooperation between the side rail weatherstrip element, the upper and lower sashes and the meeting rail weatherstrip element taken along line 3—3 of FIG. 1.
Figure 4:
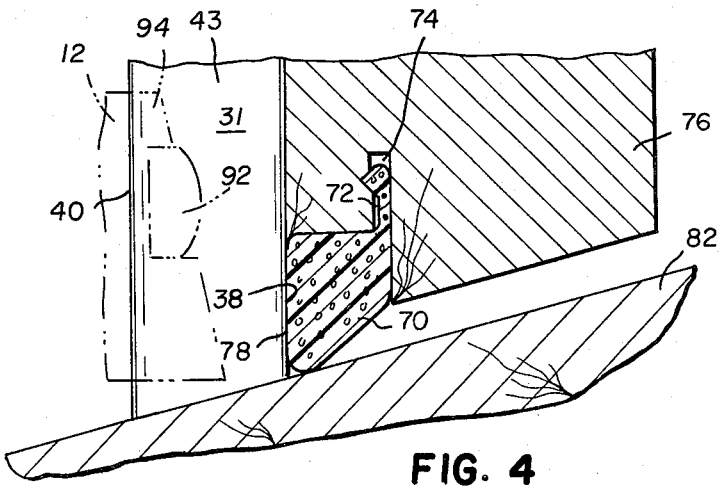
FIG. 4 is a sectional view of the bottom rail of the window of FIG. 1 taken along line 4—4.

Top rail and bottom rail weatherstrip elements 60 and 70, as seen in FIGS. 2 and 4, respectively, each include anchoring portions 62 and 72 insertable in slots 64 and 74 in the upper and lower rails 66 and 76 of the upper and lower sashes 12 and 14, respectively. Each of these weatherstrip elements preferably includes a compressible foam body surrounded by a flexible film formed in substantially the same manner as hereinabove discussed in connection with elements 30 and 31. When the various weatherstrip elements of this invention are formed in a continuous process and cut to length, the ends of the weatherstrip elements, where the compressible foam is exposed, may be treated by dipping in wax or a similar sealing material to seal the ends so that water is not absorbed by the foam.

Each of top rail weatherstrip element 60 and bottom rail weatherstrip element 70 forms a sliding seal with side rail weatherstrip elements 30 and 31, and a compression seal with a head sill 80 and a bottom sill 82. It will be appreciated, by referring to the drawings, that sealing surface 78 of bottom rail weatherstrip element 70 sealingly engages sealing face 38 of weatherstrip elements 30 and 31 while surface 68 of weatherstrip element 60 sealingly engages sealing face 40 of weatherstrip elements 30 and 31.

Figure 5:
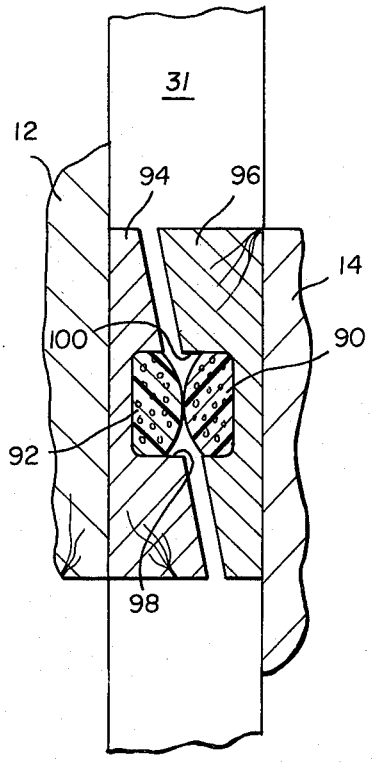
FIG. 5 is a sectional view of the meeting rail of the window of FIG. 1 taken along line 5—5.

Referring now to FIG. 5, meeting rail weatherstrip elements 90 and 92 are illustrated. Each of sashes 12 and 14 is provided with meeting rails 94 and 96, respectively. Meeting rail 94 has a centrally-located slot 98 therein for receiving weatherstrip element 92; and meeting rail 96 has a similar slot 100 for receiving weatherstrip element 90. The ends of weatherstrip elements 90 and 92 sealingly engage surfaces 42 of weatherstrip elements 30 and 31, respectively. While cooperating meeting rail weatherstrips 90 and 92 are shown in accordance with this presently preferred embodiment of the invention; it will be understood that a single weatherstrip element mounted on either of meeting rails 94 or 96 and of suitable configuration to sealingly engage the other meeting rail when the sashes are in the closed position, may be employed.

If desired, the weatherstripping in this invention may be modified somewhat from the arrangement shown to make raising and lowering of the sashes easier. Specifically, side rail weatherstrips 30 and 31 may be mounted in such a way as to contact meeting rail weatherstrip elements 90 and 92 only when sashes 12 and 14 are in their closed positions. Specifically, weatherstrip elements 30 and 31 may be displaced away from the jamb liners in the direction normal to slot 46 at the center thereof so that the ends of the horizontal weatherstrip elements 90 and 92 contact faces 42 of weatherstrips 30 and 31 only when the sashes are in the closed position thus reducing friction between the weatherstrips as the sashes are raised and lowered.

While the weatherstripping system of this invention has been illustrated in connection with a double-hung window having permanently installed sashes, it will be appreciated by those skilled in the art that the invention may be equally well employed in connection with a window of conventional design having removable sashes, without substantially changing the weatherstripping system. This provides a further advantage over previous weatherstripping systems where the weatherstrip elements would not allow the easy removal of one or more of the sashes without damaging the weatherstrip elements.

While the invention has been shown and described in connection with a presently preferred embodiment thereof, those skilled in the art will recognize that further modifications and changes may be made therein without departing from the true spirit and scope of the invention which is intended to be limited solely by the appended claims.

What is claimed is:

1. In a double-hung window of the type including upper and lower sashes slidably mounted in opposed facing side jambs and movable between top and bottom rails the improved sealing apparatus comprising:

first and second resilient weatherseal elements attached to said side jambs, each of said weatherseal elements having first and second sealing surfaces substantially perpendicular to said side jambs and a third sealing surface substantially parallel to said side jambs;

third and fourth resilient weatherseal elements carried by said upper and lower sashes respectively, said third weatherseal element sealingly engaging said first sealing surfaces of each of said first and second resilient weatherseal elements said fourth weatherseal element sealingly engaging said second sealing surfaces of each of said first and second resilient weatherseal elements; and a fifth weatherseal element carried by one of said sashes sealingly engaging the other of said sashes and said third surfaces of each of said first and second weatherseal elements.

2. The sealing apparatus of claim 1 wherein said third and fourth resilient weatherseal elements sealingly engage said top and bottom rails when said sashes are in there closed position.

3. The sealing apparatus of claim 1 wherein each of said resilient weatherseal elements comprises a foam body.

4. The sealing apparatus of claim 1 wherein each of said side jambs comprises a U-shaped channel and each of said first and second resilient weatherseal elements comprises a body having a base adapted to be inserted within said channel.

5. In a double-hung window including upper and lower sashes slidably mounted between first and second side jambs for movement between an open and a closed position, the improved weatherstrip assembly comprising:

first and second resilient weatherstrip means disposed adjacent said first and second side jambs, respectively, each of said weatherstrip means sealingly engaging both of said upper and lower sashes;

third and fourth resilient weatherstrip means disposed adjacent a top rail of said upper sash and the bottom rail of said lower sash, respectively, and each sealingly engaging both of said first and second weatherstrip means;

fifth and sixth weatherstrip means disposed adjacent a check rail of said upper and lower sashes and sealingly engaging both of said first and second weatherstrip means and each other when each of said sashes is in said closed position.

6. The weatherstrip assembly of claim 5 wherein said window further comprises sill and head members wherein said third and fourth resilient weatherstrip means sealingly engage said sill and head members respectively, when said sashes are in said closed position.

7. The weatherstrip assembly of claim 5 wherein said first and second weatherstrip means each include first, second and third sealing surfaces, said first and second sealing surfaces engaging first and second facing inner surfaces of said third and fourth weatherstrip means, respectively.

8. The weatherstrip assembly of claim 7 wherein said third sealing surfaces sealingly engage each of said fifth and sixth resilient weatherstrip means.

9. The weatherstrip assembly of claim 8 wherein said fifth and sixth weatherstrip means comprise convex sealing surfaces adapted for mutual sealing engagement when said sashes are in said closed position.

10. A double-hung window comprising:

first and second side jambs;

a head member and sill member each disposed between said side jambs and substantially perpendicular thereto;

first and second sashes slidably mounted between said side jambs and movable between an open position and a closed position, said sashes being disposed adjacent to said head and sill members when in said closed position;

first and second resilient weatherstrip means adjacent said first and second side jambs, respectively;

third and fourth resilient weatherstrip means carried by said first and second sashes, respectively, each of said third and fourth resilient weatherstrip means sealing engaging each of said first and second resilient weatherstrip means; and fifth weatherstrip means carried by one of said first and second sashes sealing engaging the other one of said sashes when said sashes are in the closed position.

11. The window of claim 10 wherein said first and second side jambs are provided with first and second jamb liners, respectively, each of said jamb liners including a channel for carrying said first and second resilient weatherstrip means, respectively.

12. The window of claim 11 wherein said first and second resilient weatherstrip means comprise an elongated element substantially T-shaped in cross-section and including a first sealing surface engaging said fifth weatherstrip means and second and third sealing surfaces at substantially right angles to said first sealing surface and sealingly engaging said first and second weatherstrip means and a base adapted to fit within said U-shaped channel.

13. The window of claim 10 comprises sixth weatherstrip means carried by said second sash and sealingly engaging said fifth weatherstrip means when said sashes are in their closed position.

14. The window of claim 10 wherein each of said weatherseal elements comprises a foam body.

15. The window of claim 10 wherein said third and fourth weatherseal elements also engage said upper and lower sills, respectively, when said sashes are in their closed positions.

16. The window of claim 10 wherein each of said weatherseal elements comprises an elongated resilient body having a cross-section that is substantially constant along the length of the body.

* * * * *